United States Patent [19]

Davies

[11] 4,389,865

[45] Jun. 28, 1983

[54] DRIVE SYSTEM FOR EDGER MILL

[75] Inventor: Kenneth W. Davies, Beaconsfield, Canada

[73] Assignee: Dominion Engineering Works, Ltd., Montreal, Canada

[21] Appl. No.: 204,447

[22] Filed: Nov. 6, 1980

[30] Foreign Application Priority Data

Nov. 27, 1979 [CA] Canada ..... 340687

[51] Int. Cl.[3] ..... B21B 35/12; B21B 35/04

[52] U.S. Cl. ..... 72/29; 72/21; 72/249; 72/443; 72/449; 74/665 N

[58] Field of Search ..... 72/8, 21, 28, 29, 195, 72/249, 443, 449; 74/665 N, 665 B; 318/69, 85

[56] References Cited

U.S. PATENT DOCUMENTS

| | | | |
|---|---|---|---|
| 2,694,170 | 11/1954 | Brown, Jr. | 318/85 |
| 3,381,509 | 5/1968 | Gay | 74/665 B |
| 3,518,859 | 7/1970 | Brinkeborn et al. | 72/249 |
| 3,670,587 | 6/1972 | Lemper | 72/249 |
| 4,166,366 | 9/1979 | Okuda et al. . | |

OTHER PUBLICATIONS

"Modern Development of Rolling Mills", by A. I. Tselikov, V. I. Zyusin, translated from the Russian language by G. Leib, MIR Publishers, Moscow, first published in 1975, pp. 88, 140 and 211.

"Construction of KOYO New Heavy Duty Drive Shaft", Koyo-Seiko Co., Ltd., Japan, pp. 5, 6, 35 and 36.

*Primary Examiner*—Francis S. Husar
*Assistant Examiner*—Jonathan L. Scherer
*Attorney, Agent, or Firm*—Daniel Patch; Suzanne Kikel

[57] ABSTRACT

An edger mill having a pair of edging rolls mounted for variable positioning apart from each other is powered by a plurality of electric motors driving the rolls from above, having a long shaft extending upwardly from each roll, with a bull wheel connected to each shaft in driving relation, each bull wheel having two or more electric motors connected thereto in driving relation by respective pinions. Synchronization between the edging rolls may be effected by mounting the bull gears in mutual intermeshing relation, or by using synchronous motors so that the common bus supply to the motors constitutes a synchronizing agency to maintain the edging rolls in synchronized relation.

8 Claims, 7 Drawing Figures

DRIVE SYSTEM FOR EDGER MILL

This invention is directed to a steel rolling mill, and in particular to a drive arrangement for an edger mill.

In operating a steel mill the rolling of a billet also includes passage through the edger stand, where the edges of the billet are rolled. In order to control the forces acting upon the billet and the edge rolls, and prevent undue skewing it is necessary to control the relative speeds of the two edge rolls, which, in view of the need to provide selectively variable spacing between the rolls, presents considerable problems to the mill builder.

While many mills in the past have relied on various types of mechanical transmission driving the mill from beneath, some recent efforts have been made to drive the rolls from above.

In accordance with the present invention there is provided an edger drive wherein each roll is driven by a plurality of electric motors, each roll being driven by a generally vertical shaft connected in driven relation through a respective bull wheel.

Speed regulation of the edging rolls is effected either by placing the respective bull wheels in mesh with each other so as to provide mechanical synchronization of the roll drive or by relying upon motor speed control, wherein the speed regulation of the fully reversible D.C. motors, throughout the range of speeds utilized is effected electrically, so as to, achieve a close degree of synchronicity, or to control the degree of asynchronicity to a predetermined limited extent. The term "synchronicity" as herein used relates only to rotational speed and has no connotation concerning in-phase quality.

In the case where overhead clearance is of no particular significance, the motors are mounted above the respective bull wheel, so that the respective motor pinions are in mesh with the related bull wheel. The selection of a plurality of motors reduces required headroom, due to the reduced size of the motors.

For applications where overhead clearance is more critical the motors may be underhung, so as to extend downwardly below the plane of the bull gears.

The utilization of a plurality of electric motors in driving relation for each bull wheel yields a number of unobvious advantages.

In the worst instance it is theoretically possible to power an edger mill with a single motor, utilizing torque transfer arrangements to drive both rolls. As the power involved may be of the order of 5,000 H.P., the size of the motor and the transmission requirements becomes prohibitive. Doubling the number of motors, so as to drive each bull wheel by a single motor reduces the transmission problems significantly. However, in the present instance of using a plurality of motors driving each bull wheel, a number of advantages accrue. Thus, where two motors are used for each bull gear the motor mounts are reduced from the requirement of a large bed plate, to the provision of four small pedestals. These pedestals then serve as open housings within which the motor couplings are located, thus serving as coupling guards.

A further advantage afforded by the adoption of a plurality of driving motors is the reduction in size, weight and complexity of manufacture of the gear drive housing.

The present invention thus provides in an edger mill having a pair of spaced apart edger rolls positioned in adjustable spaced-apart relation, each roll having an elongated shaft coupled in driving relation therewith the improvement comprising a bull gear connected with each shaft, each bull gear having a plurality of pinions connected in driving relation therewith, each pinion having a respective electric motor coupled in driving relation thereto, and motor control means to maintain the edger rolls at predetermined relative speeds of rotation.

In one embodiment the synchronizing means is provided by arranging the two bull wheels in mutual meshing relation.

In an alternative embodiment the electric motors connected in driving relation with a selected one of the bull gears are regulated, in relation to the motors driving the other bull gear, so as to provide a predetermined degree of synchronicity, or a predetermined limiting value of asynchronicity between the edger rolls.

In the case of providing electrically controlled synchronicity it is known to use accurate counting means to measure bull wheel velocity, perhaps by counting electronically the teeth of each wheel as they rotate, and varying the voltage control to one or other of the motor groups to achieve the desired correspondence of speed.

In the case where a predetermined limiting value of asynchronicity is desired, individual power supplies are provided for each bull wheel wherein, by means of voltage regulation or a speed regulator with load droop, a predetermined extent of self regulation is achieved.

Certain embodments of the invention are described, reference being had to the accompanying drawings, wherein.

Figure 1:
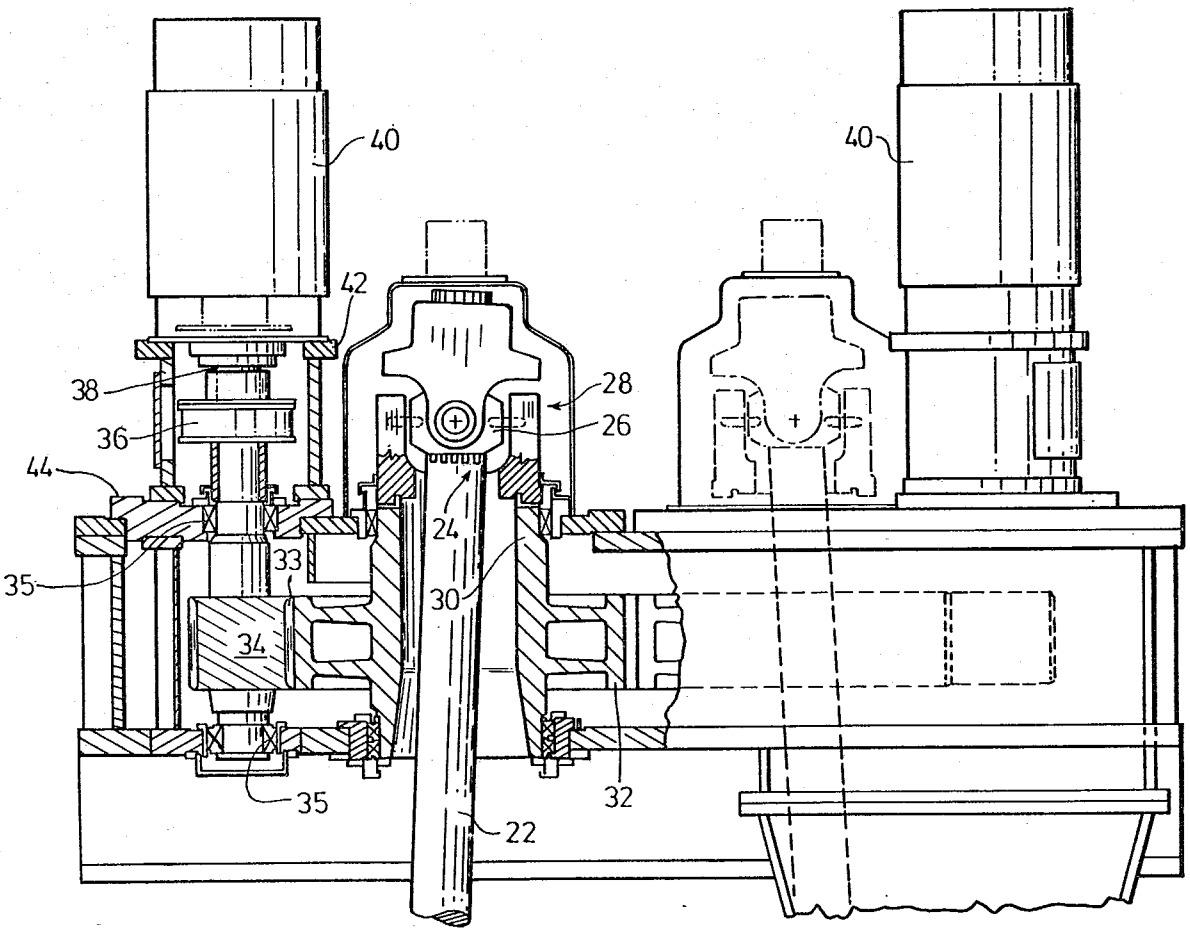
FIG. 1 is an elevation view in partial section showing an edger drive in accordance with the invention, having bull gears in mesh.
Figure 5:
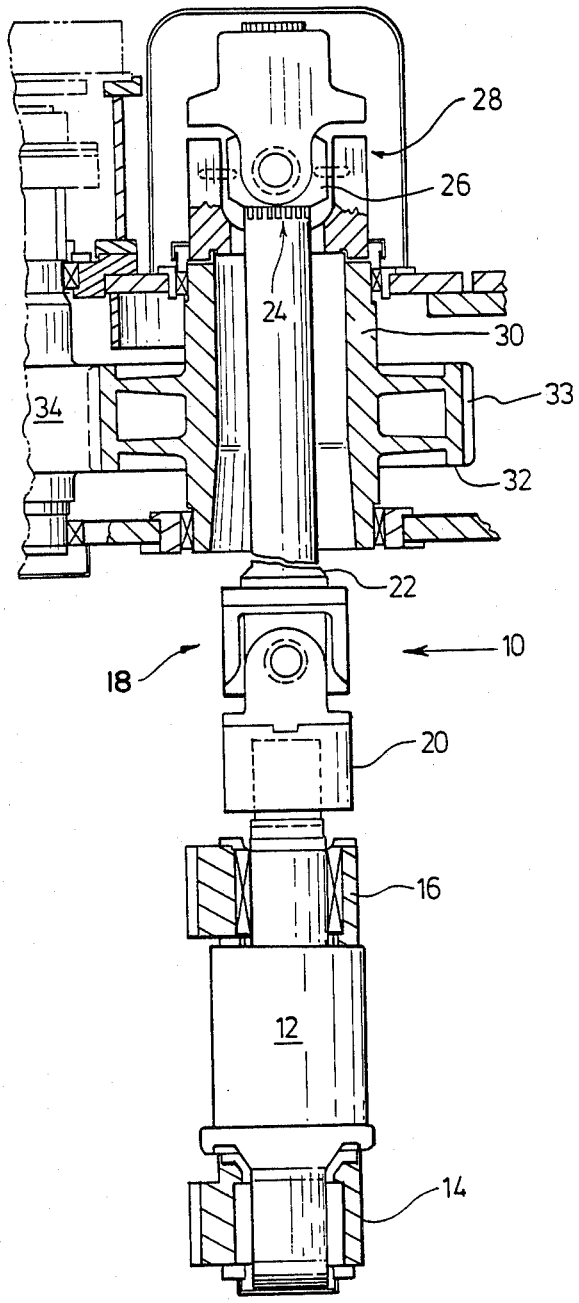
FIG. 5 is a schematic elevation of one edger roll and a portion of its drive.

Referring first to FIGS. 1 and 5, FIG. 5 shows one half of an edger mill 10 having an edge roll 12 supported between bearings 14, 16, having a lower universal bearing 18 connecting the roll 12, by way of coupling 20, to an elongated splined shaft 22. The upper splined end 24 of shaft 22 drivenly engages an upper element of a splined coupling 26 forming part of an upper universal joint 28. A lower element of coupling 26 is drivenly connected to the top of hub 30 by pins extending into this lower element. Hub 30 is part of a bull wheel 32 having a toothed outer periphery. A pinion gear 34 is shown in meshing relation with the teeth 33 of bull wheel 32.

The pinion 34 is carried between bearings 35 and connects by way of coupling 36 with the output shaft 38 of an electric motor 40.

Figure 2:
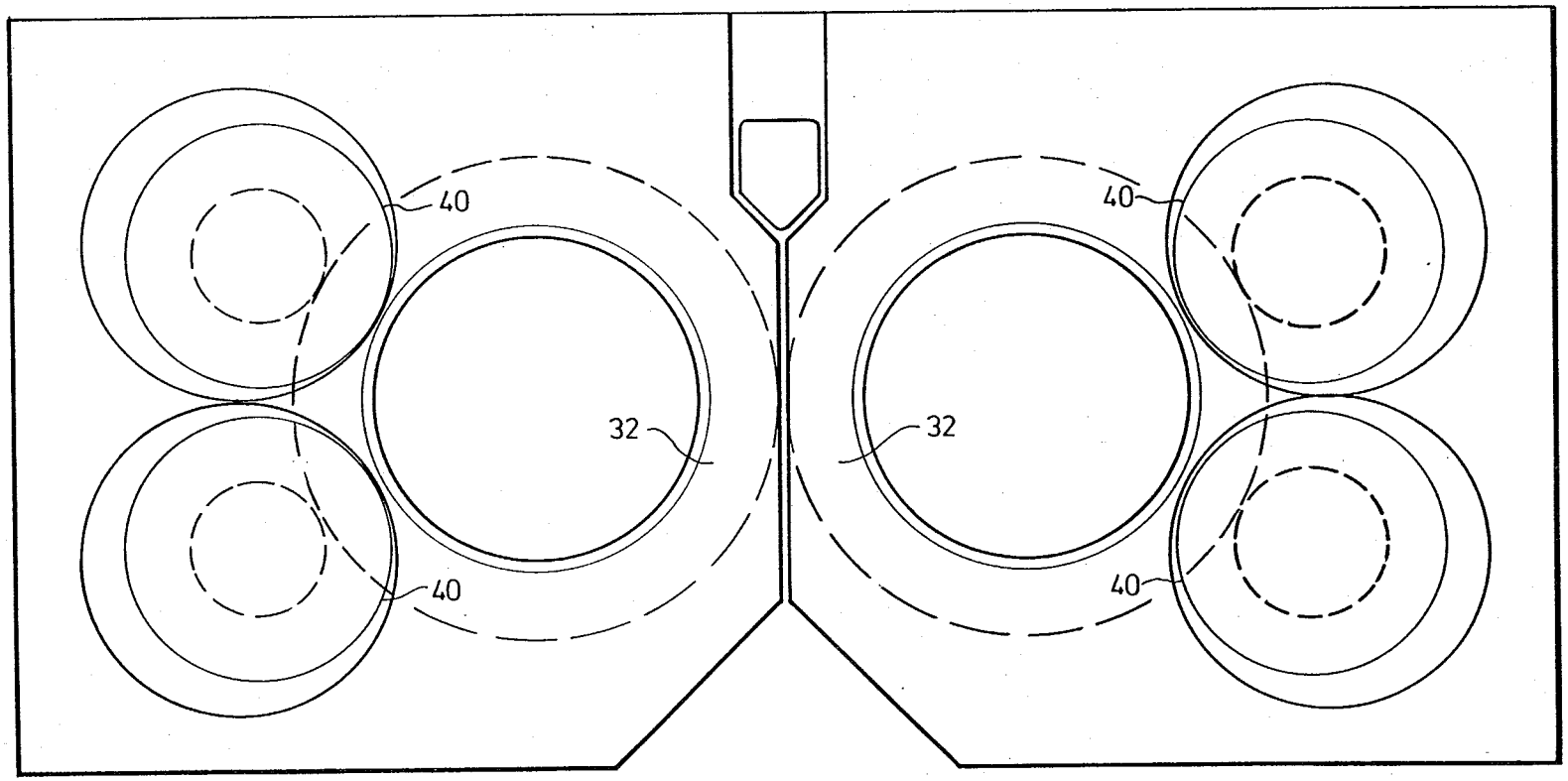
FIG. 2 is a schematic plan view of the arrangement of FIG. 1.

In the FIGS. 1, 2 embodiment there are four motors 40. Each bull wheel 32 is driven by a pair of D.C. reversible, variable speed electric motors 40. The bull wheels 32 are in mesh with each other as well as with the respective pinions 34 of the motors 40, thereby providing mechanical synchronization of the rolls 12.

The motors 40 are each attached by way of a pedestal 42 to the casing 44 wherein each of the wheels 32 and pinions 34 are housed.

Figure 3:
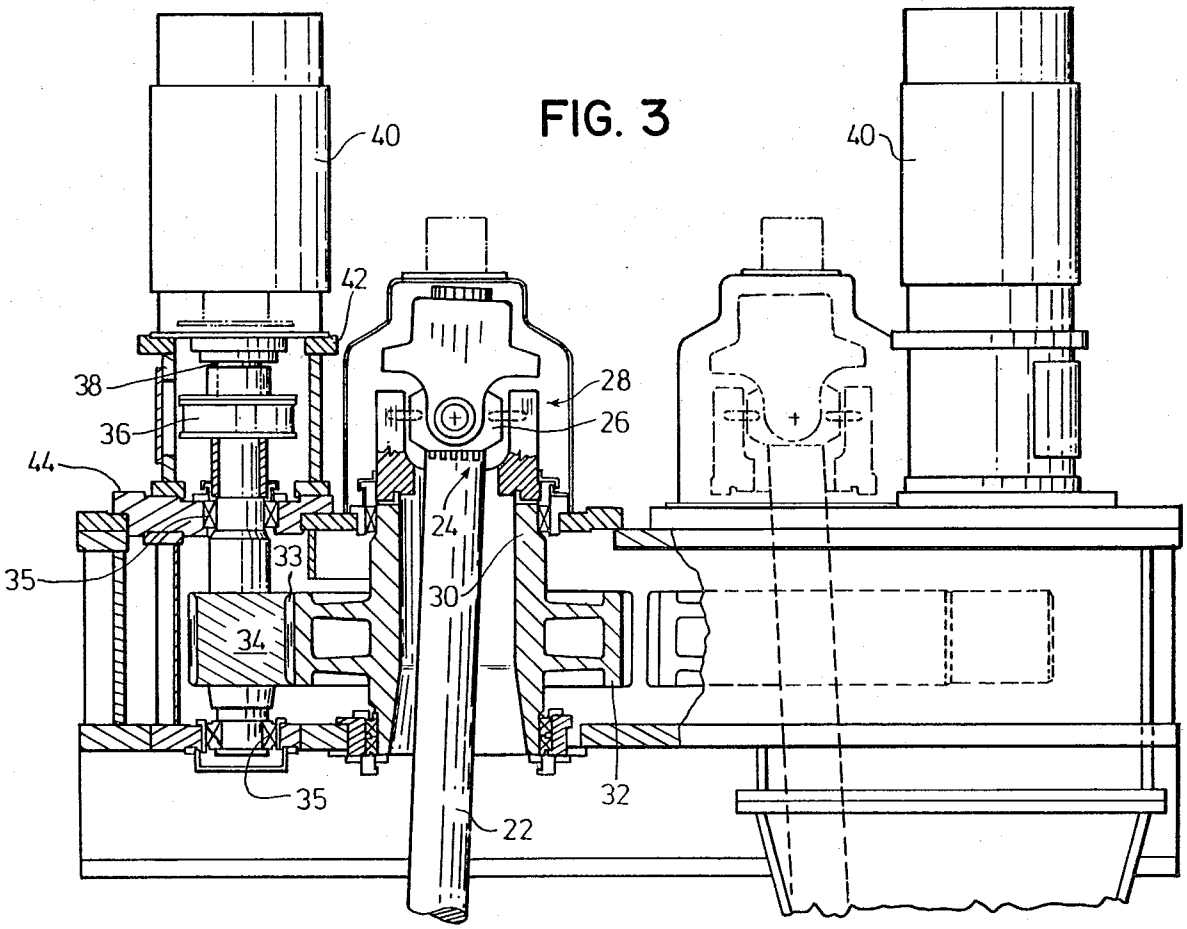
FIG. 3 is a view similar to FIG. 1 having bull gears not in mesh.
Figure 4:
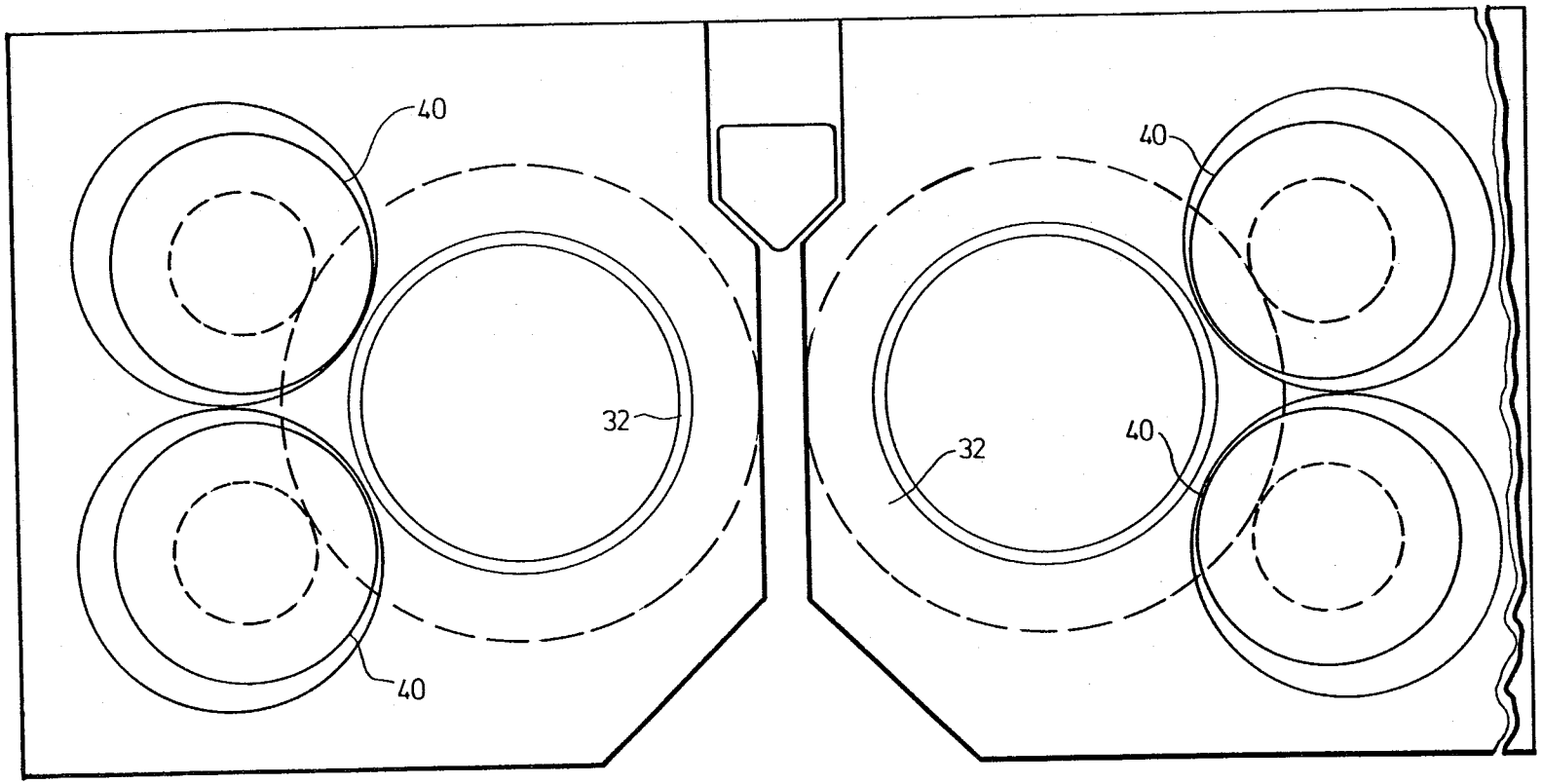
FIG. 4 is a schematic plan view of the arrangement of FIG. 3.

Turning to the FIGS. 3 and 4 embodiment, the casing 44 is arranged such that the bull wheels 32 are not in mesh. In this instance, and in the absence of mechanical synchronization, the rotational relationship between the rolls 12 is controlled by way of the electric motors 40.

Figure 6:
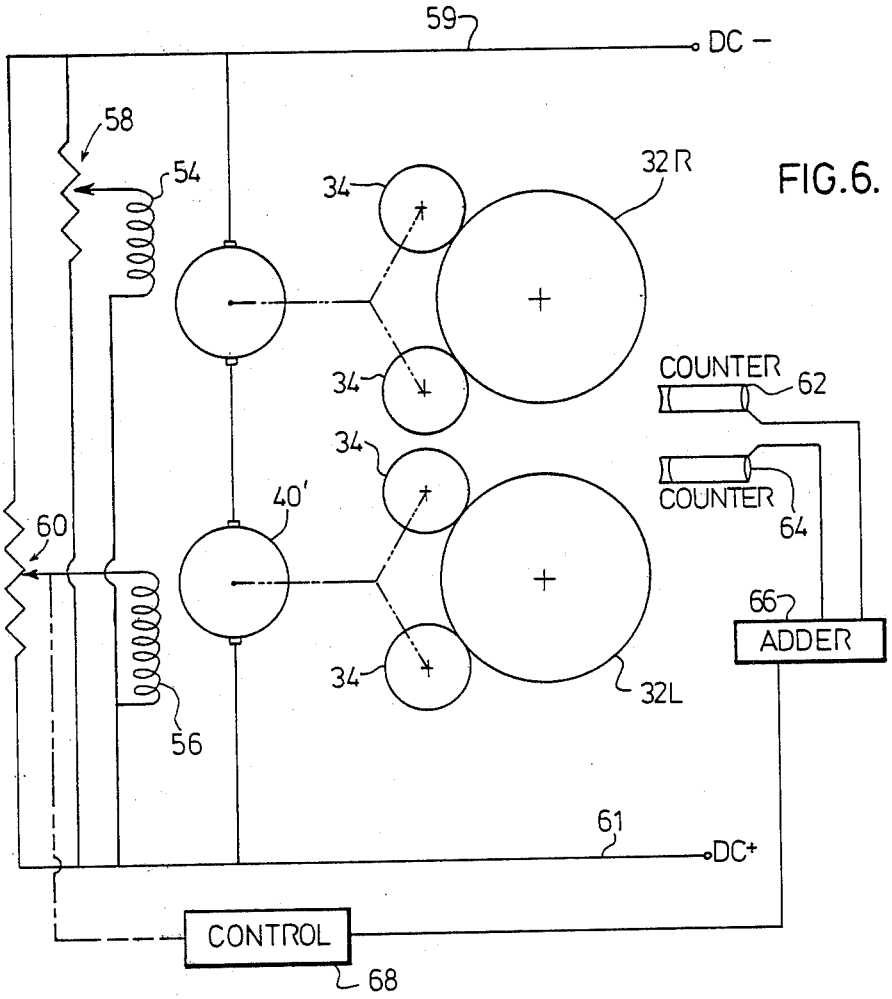
FIG. 6 is a schematic wiring diagram for an electrical control system for the edger.

Turning to FIG. 6, this shows an electrical control scheme for controlling relative rotation of the bull wheels 32, identified in FIG. 6 as 32L and 32R to signify "left" and "right" respectively.

It will be noted that each motor 40' is indicated as being connected to a pair of pinions 34. Thus each motor 40' is an "equivalent" electrical motor to the pair of individual motors 40 shown in the FIGS. 3–4 embodiments. Thus it will be understood that for purposes of providing motor control, the motors for each bull wheel 32 are illustrated as a single entity.

The armatures of motors 40' for the left and the right sides of the edger are connected in series in this illustrated embodiment for the purpose of providing a common armature current. Field coils 54, 56 are connected across the D.C. bus lines 59, 61. Field controllers 58, 60 also are connected across the bus lines 59, 61. It will be noted that the windings of the field coil 56 will be considerably more than the windings of the field coil 54, so that the field coil 56 can be regulated in relationship to the field coil 54 to produce a greater or a lesser field strength by appropriate operation of the control 68.

A pair of counters 62, 64 are connected to an adder 66. The counters 62, 64 can function on such as the teeth of the bull gears 32L, 32R. The adder 66 serves to read the count difference of the counters 62, 64, thus providing an output that is proportional to the speed difference between the respective bull gears 32L, 32R. This output is connected to control 68 which provides an output to one of the field controllers 60.

Figure 7:
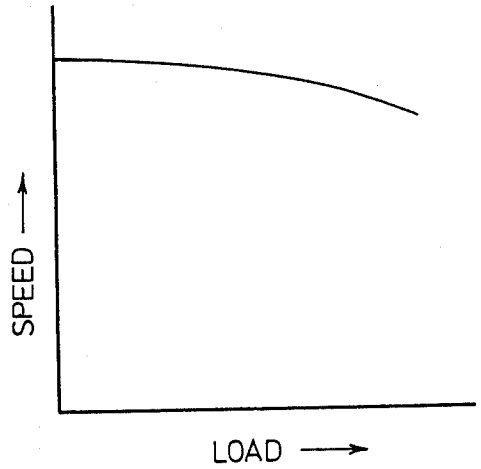
FIG. 7 is a typical speed/load characteristic of a controller suitable for the present arrangement.

The speed, load characteristic of FIG. 7 shows a droop characteristic, well-known in the art for direct current shunt motors, which means that the speed characteristic for the subject invention is only very slightly drooping, and therefore that the motors can be considered to be almost constant speed machines, therein providing stability to the system.

In operation, the disclosed apparatus may be used in three different modes. In a first condition as illustrated in FIG. 1, with the bull wheels 32 in meshing relation to provide mechanical synchronization the system operates with the two rolls 12 in synchronism, regardless of loading on the respective rolls.

In a second condition, with the bull wheels 32 disengaged, as illustrated in FIGS. 3 and 4, the speed and load sharing relationships between the rolls 12 may be controlled electrically.

Thus, using the control circuit of FIG. 6 it is possible to determine bull wheel speed, or a function thereof, using counters 62, and, by taking the count difference from the adder 66, obtain an output from adder 66 to control 68 which is a function of the speed difference between the bull wheels 32.

The control 68 may then provide regulation of the current in field coil 56, either to reduce the speed difference to a minimum achievable value, i.e. to provide synchronization, or to provide asynchronization by letting the speed of one motor combination "droop" to a predetermined difference limit, due to differences in loading between the respective rolls 12.

In whichever mode the apparatus is operated, advantages are derived from using plural motors 40 in driving relation with the respective bull wheels 32.

In accordance with the patent statutes, I have explained the principles and operation of my invention, and have illustrated and described what I consider to represent the best embodiment thereof.

The embodiments of the invention in which an exclusive property or privilege is claimed are defined as follows:

1. A convertible edger mill having a pair of spaced apart edger rolls positioned in adjustable spaced apart relation, each said roll having an elongated shaft, coupled in driving relation therewith, the improvement comprising a bull gear connected with each said shaft, said bull gears being rotatably mounted in a pair of separate housings in adjustable mutually spaced relation to permit selective positioning of the bull gears in a meshing or a non-meshing relation, each bull gear having a plurality of pinions connected in driving relation therewith, each pinion having an electrical motor in driving relation therewith, and speed control means to maintain said one edger roll within predetermined driving limits relative to the other said roll when said bull gears are positioned in said non-meshing relation.

2. The edger mill as claimed in claim 1, one said bull wheel being connected in said meshing relation with the other said bull wheel, to provide synchronized drive to the mill.

3. The edger mill as claimed in claim 1, each said electric motor being a fully reversible speed regulated motor.

4. The edger mill according to claim 1, wherein each said electric motor is a direct current motor with shunt excitation, and the motor system for one roll is controlled by variations in impedance of the shunt circuit.

5. The edger mill as claimed in claim 3 including electrical synchronizing means interconnecting the motors of one said bull wheel with the motors of the other said bull wheel, to provide substantially synchronized drive to said rolls when said bull wheels are in said non-meshing relation.

6. The edger mill as claimed in claim 3, including motor regulation means for the motors of each said bull wheel having a predetermined characteristic droop whereby asychronous operation of said mill within predetermined limits of synchronicity is provided.

7. The edger mill as claimed in claim 5, said motor regulation means comprising voltage regulation means having a drooping characteristic.

8. The edger mill as claimed in claim 6, said motor regulation means comprising a speed regulator with load droop to provide self regulation for the motors of each said bull wheel within predetermined limits.

* * * * *

UNITED STATES PATENT AND TRADEMARK OFFICE

CERTIFICATE OF CORRECTION

PATENT NO. : 4,389,865

DATED : June 28, 1983

INVENTOR(S) : Kenneth Wallace Davies

It is certified that error appears in the above-identified patent and that said Letters Patent are hereby corrected as shown below:

Column 4, line 57, claim 7: The dependency should be changed from claim 5 to --claim 6.

Column 4, line 60, claim 8: The dependency should be changed from claim 6 to --claim 7.

Signed and Sealed this

*Twentieth* Day of *September 1983*

[SEAL]

*Attest:*

GERALD J. MOSSINGHOFF

*Attesting Officer*

*Commissioner of Patents and Trademarks*